US006110421A

United States Patent [19]

Shimizu et al.

[11] Patent Number: 6,110,421

[45] Date of Patent: Aug. 29, 2000

[54] HIGH STRENGTH NON-MAGNETIC STAINLESS STEEL AND METHOD FOR PRODUCING THE SAME

[75] Inventors: Tetsuya Shimizu, Nagoya; Michio Okabe, Chita, both of Japan

[73] Assignee: Daido Tokushuko Kabushiki Kaisha, Aichi-Prefecture, Japan

[21] Appl. No.: 09/394,501

[22] Filed: Sep. 13, 1999

[30] Foreign Application Priority Data

Sep. 16, 1998 [JP] Japan ..... 10-260785

[51] Int. Cl.[7] ..... C22C 38/42; C22C 38/44; C21D 7/13

[52] U.S. Cl. ..... 420/57; 420/58; 420/59; 148/609; 148/327

[58] Field of Search ..... 420/49, 57, 58, 420/59, 73; 148/648, 605, 609, 327

[56] References Cited

U.S. PATENT DOCUMENTS 3,904,401 9/1975 Mertz et al. ..... 420/57
4,822,556 4/1989 Cordea et al. ..... 420/59
5,094,812 3/1992 Dulmaine et al. ..... 420/59

FOREIGN PATENT DOCUMENTS 62-136557 6/1987 Japan .
3-90536 4/1991 Japan .

*Primary Examiner*—Deborah Yee
*Attorney, Agent, or Firm*—Sughrue, Mion, Zinn, Macpeak & Seas, PLLC

[57] ABSTRACT

A non-magnetic stainless steel, which contains stably a large amount of N, is excellent in the corrosion resistance and the strength and possible to obtain sound ingots and products, consists by weight percentage of C≦0.08%, Si≦0.50%, 13%≦Mn≦16%, P≦0.040%, S≦0.030%, 0.35%≦Cu≦1.00%, 2.50%≦Ni≦5.50%, 17.0%≦Cr≦19.0%, 0.5%≦Mo+W≦1.0%, 0.38%≦N≦0.60%, 0≦0.0100%, sol-Al≦0.05% and the balance Fe on condition that $$86(Ni+Cu) \geq 13Cr+19Mo+9W+2Mn.$$

4 Claims, No Drawings

HIGH STRENGTH NON-MAGNETIC STAINLESS STEEL AND METHOD FOR PRODUCING THE SAME

BACKGROUND OF THE INVENTION

1. Field of the Invention

This invention relates to a high strength non-magnetic stainless steel excellent in the corrosion resistance and a method for producing the stainless steel of this kind.

2. Description of the Prior Art

For example, in a case of oil excavation using a drill, the position of the drilling bit at the bottom of the bore hole is detected from the ground surface through magnetic sensing and controlled.

In the excavator of this kind, a component called as a drill collar is equipped in the vicinity of the drill, and the drill collar is required to be made from non-magnetic material in order to detect and control the drill position through the magnetic sensing.

The drill collar is further required for corrosion resistance and high strength in addition to the non-magnetism.

Heretofore, high manganese non-magnetic stainless steels, such as 13Cr—18Mn—0.5Mo—2Ni—0.3N, 13Cr—21Mn—0.3N, 16.5Cr—16Mn—1Mo—1.3Ni—0.5Cu—0.4N or so, have been used as a material for the components required for the non-magnetism, corrosion resistance and high strength such as the drill collar.

In the non-magnetic stainless steels of this kind, it is recognized that it is effective to contain N abundantly in the steel for improving the corrosion resistance and the strength.

In the non-magnetic stainless steels containing large amounts of Mn and Cr, Mn and Cr are possible to dissolve N abundantly into the molten steel, however behave to lower solid solubility of N in the steel at the solidification stage of the molten steel, accordingly there is a problem in that it is difficult to abundantly contain N into the steel, and nitrogen blow holes are easy to be generated in the solidification process so that it is not possible to obtain sound ingots in a case of containing a large quantity of N in the steel.

SUMMARY OF THE INVENTION

Therefore, this invention is done in order to solve the aforementioned problem in the conventional high manganese non-magnetic stainless steels.

The high strength non-magnetic stainless steel according to this invention is characterized by consisting by weight percentage of not more than 0.08 of C, not more than 0.50% of Si, 13 to 16% of Mn, not more than 0.040% of P, not more than 0.030% of S, 0.35 to 1.00% of Cu, 2.50 to 5.50% of Ni, 17.0 to 19.0% of Cr, 0.5 to 1.0% in total of Mo and W, 0.38 to 0.60% of N, not more than 0.0100% of O, not more than 0.05% of sol-Al, and the remainder being substantially Fe, further Ni, Cu, Cr, Mo, W and Mn by weight percentage satisfy the following relational expression;

$$86(Ni+Cu) \geqq 13Cr+19Mo+9W+2Mn.$$

The high strength non-magnetic stainless steel according to this invention may be further contained with one or more of B, Ca, Mg, and REM (rare earth metals) in an amount of not more than 0.0100%, respectively according to demand.

The method for producing a high strength non-magnetic stainless steel according to this invention is characterized by subjecting steel material having chemical compositions according to claim 1 or 2 to finish working in a reduction ratio of 15 to 17 on condition that final working temperature at a surface of the steel material is in a range of 700 to 900° C.

DETAILED DESCRIPTION OF THE INVENTION

It is essential to respectively contain Cr and Mn in a quantity more than a predetermined certain value in order to ensure the corrosion resistance in the non-magnetic stainless steels.

The other side, when Cr and Mn are contained abundantly in the steel, it becomes to easily generate nitrogen blow holes in the solidification process of the steel as mentioned above.

Therefore, in the non-magnetic stainless steel according to this invention, Ni and Cu of the predetermined amounts are added so as to control the nitrogen blow holes generated at the time of solidification of the steel.

Inventors have found out that the forming action of the nitrogen blow holes caused y addition of Cr, Mo, W and Mn can be controlled by adding Ni and Cu, and there exists a certain quantitative relation between the amounts of these elements, Cr, Mo, W, Mn and Ni, Cu, thereby achieving the present invention.

Namely, in this invention, when Cr, (Mo+W) and Mn are added more than predetermined amounts from a viewpoint of ensuring the corrosion resistance, Ni and Cu are added in amounts balanced with the amounts of Cr, (Mo+W) and Mn, and the relationship between the amounts of these elements is shown by the following expression;

$$86(\text{wt percent Ni}+\text{wt percent Cu}) \geqq 13(\text{wt percent Cr})$$
$$+19(\text{wt percent Mo})+9(\text{wt percent W})+2(\text{wt percent Mn})$$

In the expression, the elements Cr, Mo, W and Mn in the right side are elements having tendencies to precipitate δ-ferrite phase with low solid solubility of N at the time of solidification of the steel, and each of the coefficients indicates the degree of contribution of the respective element.

Further, the elements Ni and Cu in the left side of the expression are elements having tendencies to precipitate austenite phase with high solid solubility of N at the time of solidification of the steel, and each of the coefficients indicates the degree of contribution of the respective element.

According to the present invention, it becomes possible to contain N in the amount more than the predetermined value into the steel by containing Cr, (Mo+W) and Mn in the steel at the same time of containing Ni and Cu in the amounts balanced with the amounts of the above-mentioned elements. Namely, it becomes possible to obtain sound ingots and products by inhibiting the nitrogen blow holes at the time of solidification of the steel.

In this manner, it is possible to contain N more than the predetermined quantity, and possible to further improve the non-magnetic stainless steel in the corrosion resistance and the strength as compared with the conventional steel.

In this invention, one or more of B, Ca, Mg and REM may be contained into the steel according to demand in the predetermined range described above. Whereby it is possible to improve the hot workability of the non-magnetic stainless steel.

In the method for producing the high strength non-magnetic stainless steel, the finish working is carried out in the reduction ratio of 15 to 70% on condition that final working temperature at the surface of the steel is in the range of 700 to 900° C. at the time of producing the non-magnetic stainless steel.

According to the production method of this invention, the non-magnetic stainless steel is intended to be used in a state where the strain remains in the steel, and it is possible to give the high strength for the non-magnetic stainless steel.

The definition of the upper limit of the final working temperature at the surface of the steel material into 900° C. is based on that the residual strain can be not suitably given to the non-magnetic stainless steel at a temperature higher than 900° C., and the definition of the lower limit of the final working temperature of 700° C. depends on that carbides become to be easily precipitated at grain boundaries at a temperature lower than 700° C., thereby deteriorating the corrosion resistance and the toughness.

The other side, the upper limit of the reduction ratio at the finish working is defined as 70% because it is difficult to work the stainless steel in the reduction ratio higher than 70%, and the lower limit of the reduction ratio is defined as 15% because it is not possible to sufficiently give the strain to the stainless steel by the working of the reduction ratio lower than 1.5%.

Next, an explanation will be given in detail about the reason for limiting the chemical compositions in the non-magnetic stainless steel according to this invention.

C: ≦0.08 wt %

Although C is desirable to be reduced because C is precipitated in a form of carbides including Cr and degrades properties such as the corrosion resistance, excessive suppression of C causes an increase in the cost, so that the upper limit of C is defined as 0.08%. The desirable C content is in a range of up to 0.05%.

Si: ≦0.50 wt %

Si is effective as a deoxidizer, but lowers solubility and solid solubility of N in the stainless steel and promotes precipitation of intermetallic compounds by containing Si in the amount more than 0.50%. Therefore, the upper limit of Si is defined as 0.50% in this invention. The desirable Si content is in a range of up to 0.35%.

Mn: 13~16 wt %

Mn is contained of 13% or more in order to ensure the non-magnetism of the steel and the solubility of N in molten steel. However, addition of Mn in the amount more than 16% degrades the hot workability and the corrosion resistance, and promotes generation of the nitrogen blow holes at the time of solidification, so that the upper limit of Mn is defined as 16%. The desirable Mn content is in a range of 13 to 15%.

P: ≦0.040 wt %

P is segregated at grain boundaries, thereby deteriorating properties of the stainless steel. Accordingly it is desirable to reduce P as low as possible, however the upper limit of P is defined as 0.040% considering increase of the production cost.

S: ≦0.030 wt %

It is desirable to reduce S as low as possible since S has a bad influence upon the hot workability and the corrosion resistance. The upper limit of S in this invention is defined as 0.030% in weight considering increase of the production cost.

Cu: 0.35~1.00 wt %

Ni: 2.50~5.50 wt %

Cu and Ni are effective to stably add N which is effective to improve the corrosion resistance and the strength of the stainless steel, and increase an amount of austenite phase with high solid solubility of N at the time of solidification, thereby inhibiting the formation of nitrogen blow holes.

Furthermore, each of Cu and Ni is effective for improving the corrosion resistance, therefore Cu and Ni are contained in the respective amounts of not less than 0.35% and 2.50% in the stainless steel according to this invention.

The upper limits of Cu and Ni are defined as 1.00% and 5.50%, respectively because solubility of N in molten steel is lowered and the cost is increased by excessive addition of Cu and Ni more than 1.00% and 5.50%, respectively.

The desirable Ni content is in a range of less than 5%.

Cr: 17.0~19.0 wt %

Mo+W: 0.5~1.0 wt %

These elements are indispensable in order to ensure the corrosion resistance, therefore 17% or more of Cr, and 0.5% or more of Mo+W are contained in the non-magnetic stainless steel according to this invention.

However, these elements promote to form the nitrogen blow holes at the solidification of molten steel, degrade phase-stability and brings increase of the cost, so that 19% of Cr and 1.0% of Mo+W are defined as the respective upper limits, excessive addition of these elements is controlled.

N: 0.38~0.60 wt %

N is very effective elements for improving the strength and the corrosion resistance of the non-magnetic stainless steel and ensuring the non-magnetism of the steel, and contained in an amount of 0.38% or more.

However, when N is contained more than 0.60%, it becomes easy to generate nitrogen blow holes and becomes impossible to obtain sound products of the non-magnetic stainless steel, therefore N content is controlled by defining the upper limit of N as 0.60%.

O: ≦0.0100 wt %

O deteriorates cleanliness of the steel, and degrades the hot workability, the corrosion resistance, the toughness and the like, accordingly O is controlled to not more than 0.0100%.

Sol-Al: ≦0.05wt %

Sol-Al deteriorates cleanliness of the steel, and degrades the hot workability, the corrosion resistance, the toughness and the like similarly to O, so that sol-Al is controlled to not more than 0.05%.

One or more of B, Ca, Mg and REM: ≦0.0100 wt %

These elements are effective for improving the hot workability of the steel, but deteriorates cleanliness of the steel by excessive addition of the respective elements of more than 0.0100%. Therefore, these elements are controlled by defining the upper limits as 0.0100%, respectively.

$86(Ni+Cu) \geqq 13Cr+19Mo+9W+2Mn$

In order to inhibit the formation of nitrogen blow holes at the time of solidification of the molten steel, the respective contents of Ni, Cu, Cr, Mo, W and Mn are controlled so that calculated value of the left side in the above-mentioned expression may be equal to or exceed calculated value of the right side.

EXAMPLES

Next, examples of this invention will be described below in detail.

Non-magnetic stainless steels of inventive example No. 1, 2, 3, 13 and 14, and comparative example No. 5 among the non-magnetic stainless steels having chemical compositions shown in Table 1 were melted in a AOD (argon oxygen decarburization) furnace and cast into 3.6 ton ingots, respectively, The obtained ingots were subjected to hot forging at 1100° C. and beaten into rods of 300 mm square.

Subsequently, the hot forged square rods were cooled once and heated again at 850~1100° C. Then the square rods were subjected to finish working of respective working ratios (reduction ratios) shown in Table 1 under respective thermal conditions such that surface temperature of the square rods under the working would drop finally into the respective temperature shown in Table 1 after starting the working at 850~900° C.

The producibility of the respective non-magnetic stainless steel in the finish working was investigated and the various characteristics of the stainless steel obtained through the above-mentioned finish working, such as corrosion resistance, tensile properties, magnetic properties and so, were measured. The obtained results are shown in Table 2.

The other non-magnetic stainless steels (inventive example Nos. 4 to 13, and comparative example Nos. 1 to 4) were similarly melted and cast into 50 kg ingots, and the obtained ingots were beaten into rods of 50 mm square through hot forging at 1100° C., respectively. After this, the hot forged square rods were cooled once and heated again, and subjected to finish working of respective reduction ratios shown in Table 1 under respective thermal conditions such that surface temperature of the square rods under the working would drop into the respective temperature shown in Table 1 after starting the working at 850~900° C. similarly as mentioned above.

The producibility at the finish working and the various characteristics of the finish worked stainless steels were investigated. The obtained results are also shown in Table 2.

TABLE 1-1

| | | C | Si | Mn | P | S | Cu | Ni | Cr | Mo | W | N | O | s-Al | others |
|---|---|---|---|---|---|---|---|---|---|---|---|---|---|---|---|
| Inventive example | 1 | 0.039 | 0.25 | 14.91 | 0.028 | 0.002 | 0.56 | 2.87 | 17.96 | 0.84 | 0.02 | 0.42 | 0.0065 | 0.002 | |
| | 2 | 0.043 | 0.2 | 14.86 | 0.014 | 0.005 | 0.52 | 3.01 | 17.94 | 0.98 | | 0.41 | 0.0087 | 0.013 | |
| | 3 | 0.031 | 0.29 | 14.62 | 0.021 | 0.009 | 0.42 | 2.9 | 18.12 | 0.42 | 0.15 | 0.39 | 0.0061 | 0.003 | |
| | 4 | 0.024 | 0.15 | 15.33 | 0.031 | 0.001 | 0.38 | 3.12 | 18.63 | 0.54 | | 0.44 | 0.0049 | 0.005 | |
| | 5 | 0.055 | 0.32 | 14.43 | 0.006 | 0.002 | 0.69 | 2.58 | 17.48 | 0.85 | 0.08 | 0.43 | 0.0065 | 0.001 | |
| | 6 | 0.009 | 0.22 | 15.83 | 0.027 | 0.001 | 0.72 | 2.76 | 18.2 | 0.72 | | 0.46 | 0.0069 | 0.011 | |
| | 7 | 0.043 | 0.19 | 14.22 | 0.019 | 0.003 | 0.55 | 2.99 | 17.37 | 0.8 | | 0.41 | 0.0059 | 0.007 | |
| | 8 | 0.035 | 0.38 | 15.01 | 0.032 | 0.006 | 0.46 | 2.81 | 18.01 | 0.62 | | 0.45 | 0.0077 | 0.003 | |
| | 9 | 0.041 | 0.24 | 13.81 | 0.029 | 0.002 | 0.59 | 2.92 | 17.89 | 0.86 | | 0.4 | 0.0084 | 0.022 | |
| | 10 | 0.024 | 0.07 | 15.15 | 0.025 | 0.006 | 0.49 | 3.52 | 18.23 | 0.65 | 0.21 | 0.42 | 0.0043 | 0.001 | 0.0024Mm (*) |
| | 11 | 0.033 | 0.28 | 15.07 | 0.022 | 0.012 | 0.71 | 2.68 | 18.07 | 0.9 | | 0.44 | 0.0035 | 0.003 | 0.0032Ca |
| | 12 | 0.052 | 0.25 | 15.32 | 0.013 | 0.006 | 0.46 | 3.08 | 17.83 | 0.95 | | 0.41 | 0.0076 | 0.007 | 0.0011B |
| Comparative example | 1 | 0.039 | 0.32 | 15.84 | 0.024 | 0.01 | | | 18.02 | 0.97 | | 0.46 | 0.0068 | 0.004 | |
| | 2 | 0.041 | 0.51 | 15.24 | 0.031 | 0.003 | 0.12 | 0.89 | 18.31 | 0.52 | | 0.43 | 0.0079 | 0.005 | |
| | 3 | 0.038 | 0.25 | 14.79 | 0.019 | 0.004 | 0.24 | 0.5 | 14.79 | 1.52 | | 0.45 | 0.0056 | 0.002 | |
| | 4 | 0.044 | 0.25 | 13.88 | 0.023 | 0.001 | 0.66 | 3.01 | 18.11 | 0.84 | | 0.22 | 0.0092 | 0.016 | |
| Inventive example | 13 | 0.039 | 0.25 | 14.91 | 0.028 | 0.002 | 0.56 | 2.87 | 17.96 | 0.84 | 0.02 | 0.42 | 0.0065 | 0.002 | |
| | 14 | 0.039 | 0.25 | 14.91 | 0.028 | 0.002 | 0.56 | 2.87 | 17.96 | 0.84 | 0.02 | 0.42 | 0.0065 | 0.002 | |
| Comparative example | 5 | 0.036 | 0.38 | 17.98 | 0.021 | 0.002 | 0.01 | 1.97 | 12.7 | 0.52 | | 0.29 | 0.0067 | 0.011 | 0.27Nb |

(*) Mm:Ce + La

TABLE 1-2

| | | L-Value (**) | R-Value (***) | Satisfaction of relational expression | Final working temperature at finish working (°C.) | Reduction ratio (%) | Satisfaction of finish working condition |
|---|---|---|---|---|---|---|---|
| Inventive example | 1 | 294.98 | 279.44 | ○ | 760 | 45 | ○ |
| | 2 | 303.58 | 281.56 | ○ | 800 | 45 | ○ |
| | 3 | 285.52 | 274.13 | ○ | 800 | 33 | ○ |
| | 4 | 301 | 283.11 | ○ | 835 | 33 | ○ |
| | 5 | 281.22 | 272.97 | ○ | 830 | 45 | ○ |
| | 6 | 299.28 | 281.94 | ○ | 850 | 33 | ○ |

TABLE 1-2-continued

| | | L-Value (**) | R-Value (***) | Satisfaction of relational expression | Final working temperature at finish working (°C.) | Reduction ratio (%) | Satisfaction of finish working condition |
|---|---|---|---|---|---|---|---|
| | 7 | 304.44 | 269.45 | ○ | 720 | 60 | ○ |
| | 8 | 281.22 | 275.93 | ○ | 780 | 45 | ○ |
| | 9 | 301.86 | 276.53 | ○ | 820 | 45 | ○ |
| | 10 | 344.86 | 281.53 | ○ | 805 | 45 | ○ |
| | 11 | 291.54 | 282.15 | ○ | 795 | 33 | ○ |
| | 12 | 304.44 | 280.48 | ○ | 775 | 45 | ○ |
| Comparative example | 1 | 0 | 284.37 | x | — | — | — |
| | 2 | 86.86 | 278.39 | x | — | — | — |
| | 3 | 63.64 | 250.73 | x | — | — | — |
| | 4 | 315.62 | 279.15 | ○ | 760 | 45 | ○ |
| Inventive example | 13 | 294.98 | 279.44 | ○ | 620 | 45 | x |
| | 14 | 294.98 | 279.44 | ○ | 780 | 5 | x |
| Comparative example | 5 | 170.28 | 210.94 | x | 750 | 45 | ○ |

(**) L-Value: 86(Ni + Cu)
(***) R-Value: 13Cr + 19Mo + 9W + 2Nn

TABLE 2

| | | Producibility | Salt Spray Testing | 0.2% Proof Stress (MPa) | Tensile Strength (MPa) | Elongation (%) | Reduction of Area (%) | Impact Value (J/cm$^2$) | Corrosion Bend Test | Magnetic Permeability |
|---|---|---|---|---|---|---|---|---|---|---|
| Inventive example | 1 | ○ | A | 872 | 989 | 30 | 62 | 139 | ○ | 1.002 |
| | 2 | ○ | A | 831 | 941 | 31 | 64 | 156 | ○ | 1.001 |
| | 3 | ○ | A | 810 | 934 | 31 | 65 | 152 | ○ | 1.003 |
| | 4 | ○ | A | 776 | 906 | 32 | 67 | 164 | ○ | 1.002 |
| | 5 | ○ | A | 824 | 961 | 29 | 59 | 144 | ○ | 1.002 |
| | 6 | ○ | A | 790 | 927 | 30 | 61 | 138 | ○ | 1.003 |
| | 7 | ○ | A | 955 | 1044 | 26 | 57 | 132 | ○ | 1.001 |
| | 8 | ○ | A | 893 | 1023 | 28 | 58 | 136 | ○ | 1.002 |
| | 9 | ○ | A | 817 | 1023 | 27 | 57 | 129 | ○ | 1.002 |
| | 10 | ○ | A | 852 | 961 | 31 | 63 | 149 | ○ | 1.002 |
| | 11 | ○ | A | 879 | 1016 | 29 | 60 | 140 | ○ | 1.002 |
| | 12 | ○ | A | 893 | 1030 | 25 | 58 | 143 | ○ | 1.003 |
| Comparative example | 1 | x | — | — | — | — | — | — | — | — |
| | 2 | x | — | — | — | — | — | — | — | — |
| | 3 | x | — | — | — | — | — | — | — | — |
| | 4 | ○ | B | 700 | 838 | 34 | 66 | 159 | x | 1.03 |
| Inventive example | 13 | ○ | A | 968 | 1119 | 21 | 48 | 89 | Δ | 1.002 |
| | 14 | ○ | A | 522 | 742 | 39 | 69 | 190 | ○ | 1.002 |
| Comparative example | 5 | ○ | D | 769 | 893 | 28 | 55 | 64 | x | 1.005 |

The respective tests and the evaluation of the characteristics shown in Table 2 were carried out according to the following methods.

Producibility

The producibility was evaluated by examining the presence of nitrogen blow holes in the obtained ingots. In this time, the judgement was done on basis of the existence of shrinkage cavities concerning the large-sized ingots (3.6 ton), and the observation is done concerning the small-sized ingots (50 kg) through gamma-ray irradiation.

Salt Spray Testing

Test pieces were dipped in a aqueous solution of 5% NaCl at 35° C. for 96 hours. The results were indicated as evaluation A with respect to the test piece not corroded at all, as evaluation B with respect to the test piece corroded slightly, as evaluation C with respect to the test piece corroded in some degree, and as evaluation D with respect to the test piece corroded almost on the whole surface.

Tension Test

The test was performed according to JIS Z 2241 (Method of Tension Test for Metallic Materials) using No. 4 test pieces (10 mm in diameter) specified in JIS Z 2201 (Tension Test Pieces for Metallic Materials).

Impact Test

The test was performed according to JIS Z 2242 (Method of Impact Test for Metallic Materials) using No. 4 test pieces (2 mm V-notch) specified in JIS Z 2202 (Impact Test Pieces for Metallic Materials).

Corrosion Bend Test

The bend test was carried out using the plate-shaped test pieces of 5 mm$^t$×20 mm×70 mm after dipping the test pieces into copper sulfate-sulfuric acid corrosive liquid according to JIS G 0575 (Copper Sulfate-Sulfuric Acid Test for Stainless Steels). The test pieces were bent up to 150 degree in this case.

The obtained results were evaluated as ○ in a case where no crack was noticed on an outside surface of the test piece, and evaluated as Δ or X according to the extent of cracks on the outside surface of the test piece in a case where the cracks were noticed.

Magnetic Permeability

The magnetic permeability was measured in the external magnetic field of 2000 Oe according to VSM method.

As is seen from the results shown in Table 2, in the non-magnetic stainless steel of comparative example 1 which contains N in the suitable range of this invention but is not added with Cu and Ni, and the non-magnetic stainless steel of comparative examples 2 and 3 which contain N similarly, but contain Cu and Ni in merely small amounts less than suitable range of this invention, nitrogen blow holes were generated and the producibility was not so excellent.

Further, in the non-magnetic stainless steel of comparative example 4, the relational expression specified in this invention is satisfied but N content is lower than the suitable range of this invention, therefore the results of the salt spray testing and corrosion bend test were not favorable and it is not sufficient also in the strength.

The non-magnetic stainless steels of inventive examples 13 and 14 have the same chemical compositions as those of steel of inventive example 1 and belongs to the present invention in the chemical composition, however is not subjected to the finish working under the preferable working condition specified in the method according to this invention.

Namely, the stainless steel of inventive example 13 was subjected to the finish working finally at 620° C., which is lower than desirable temperature of 700° C. specified in the method according to this invention, and the stainless steel of inventive example 14 was subjected to the finish working at the final working temperature in the preferable range specified in the method according to this invention, but the finish working was carried out in the reduction ratio of 5%, which is lower than the desirable lower limit of 15% specified in the method of this invention.

Consequently, the non-magnetic stainless steel of inventive example 13 has excellent properties as compared with the stainless steels of comparative examples, but not excellent in the result of corrosion bend test as compared with the stainless steels of inventive examples 1 to 12 in some degree. Furthermore, the non-magnetic stainless steel of inventive example 14 is not so excellent in the strength as compared with the steels of inventive examples 1 to 12 because the reduction ratio of the finish working is low and the strain is not finally remained so much.

The non-magnetic stainless steel of comparative example 5 is not sufficient in amounts of Cu, Ni, Cr in addition to N content and the relational expression is not satisfied. For this reason, the stainless steel is not excellent in the salt spray test and the corrosion bend test and is not sufficient in the strength.

In the non-magnetic stainless steels of inventive examples 1 to 12, which are in the range specified by this invention in the chemical compositions and the working and thermal conditions of the finish working, it is confirmed that these steels are excellent in the producibility, and excellent results can be obtained in the corrosion resistance and the strength as compared with the non-magnetic stainless steels of comparative examples.

Although the examples of this invention have been descried above in detail, these are merely examples for explaining this invention, so that this invention is not limited to the above-mentioned examples and it is possible to practice the invention in various forms without departing from the spirit and scope of this invention.

The non-magnetic stainless steel according to this invention is suitable for material of the drill collar as mentioned above, and it is also possible to apply as materials for a retainer ring required for the corrosion resistance, the high strength and the non-magnetism, a particle accelerator used with superconducting magnets, various members of the nuclear fusion reactor, linear motor car members, marine members incompatible with magnetism and so on, for example.

What is claimed is:

1. A high strength non-magnetic stainless steel consisting by weight percentage of not more than 0.08% of C, not more than 0.50% of Si, 13 to 16% of Mn, not more than 0.040% of P, not more than 0.030% of S, 0.35 to 1.00% of Cu, 2.50 to 5.50% of Ni, 17.0 to 19.0% of Cr, 0.5 to 1.0% in total of Mo and W, 0.38 to 0.60% of N, not more than 0.0100% of O, not more than 0.05% of sol-Al, and the remainder being substantially Fe, wherein Ni, Cu, Cr, Mo, W and Mn by weight percentage satisfy the following relational expression;

$$86(Ni+Cu) \geqq 13Cr+19Mo+9W+2Mn.$$

2. A high strength non-magnetic stainless steel consisting by weight percentage of not more than 0.08% of C, not more than 0.50% of Si, 13 to 16% of Mn, not more than 0.040% of P, not more than 0.030% of S, 0.35 to 1.00% of Cu, 2.50 to 5.50% of Ni, 17.0 to 19.0% of Cr, 0.5 to 1.0% in total of Mo and W, 0.38 to 0.60% of N, not more than 0.0100% of O, not more than 0.05% of sol-Al, one or more of B, Ca, Mg and REM in a respective amount of not more than 0.0100%, and the remainder being substantially Fe, wherein Ni, Cu, Cr, Mo, W and Mn by weight percentage satisfy the following relational expression;

$$86(Ni+Cu) \geqq 13Cr+19Mo+9W+2Mn.$$

3. A method for producing a high strength non-magnetic stainless steel characterized by subjecting steel material having chemical compositions according to claim 1 to finish working in a reduction ratio of 15 to 70% on condition that final working temperature at a surface of said steel material is in a range of 700 to 900° C.

4. A method for producing a high strength non-magnetic stainless steel characterized by subjecting steel material having chemical compositions according to claim 2 to finish working in a reduction ratio of 15 to 70% on condition that final working temperature at a surface of said steel material is in a range of 700 to 900° C.

* * * * *